US007484669B2

(12) United States Patent
Gray, Jr.

(10) Patent No.: US 7,484,669 B2
(45) Date of Patent: Feb. 3, 2009

(54) INSULATED RAIL FOR ELECTRIC TRANSIT SYSTEMS AND METHOD OF MAKING SAME

(75) Inventor: Harold W. Gray, Jr., Denver, CO (US)

(73) Assignee: MetroShield LLC, Denver, CO (US)

( * ) Notice: Subject to any disclaimer, the term of this patent is extended or adjusted under 35 U.S.C. 154(b) by 267 days.

(21) Appl. No.: 11/098,886

(22) Filed: Apr. 5, 2005

(65) Prior Publication Data

US 2007/0034705 A1 Feb. 15, 2007

(51) Int. Cl.
*E01B 1/00* (2006.01)

(52) U.S. Cl. ..... 238/3; 238/2; 238/5; 238/6; 238/7

(58) Field of Classification Search ..... 238/2, 238/3, 8, 6, 7, 283, 382, 149, 122
See application file for complete search history.

(56) References Cited

U.S. PATENT DOCUMENTS

| | | | | |
|---|---|---|---|---|
| 2,045,253 | A * | 6/1936 | Saurer | 238/9 |
| 3,223,328 | A | 12/1965 | Moses et al. | |
| 3,295,760 | A | 1/1967 | Moses | |
| 3,610,526 | A | 10/1971 | Burwell | |
| 3,662,951 | A | 5/1972 | Smith et al. | |
| 3,826,424 | A | 7/1974 | McClung et al. | |
| 3,904,112 | A | 9/1975 | Thim et al. | |
| 3,945,566 | A | 3/1976 | Bush | |
| 4,641,779 | A * | 2/1987 | O'Brien et al. | 238/7 |
| 4,925,094 | A | 5/1990 | Buekett | |
| 5,110,046 | A | 5/1992 | Youg | |
| 5,405,081 | A | 4/1995 | Bosshart | |
| 5,549,245 | A | 8/1996 | Kish | |
| 5,551,632 | A | 9/1996 | Kish et al. | |
| 5,551,633 | A | 9/1996 | Kish et al. | |
| 6,079,631 | A | 6/2000 | Ortwein et al. | |
| 6,296,195 | B1 | 10/2001 | Blank et al. | |
| 6,354,512 | B2 * | 3/2002 | Vennell | 238/2 |
| 6,386,461 | B1 * | 5/2002 | Wildgoose | 238/283 |
| 6,752,322 | B2 | 6/2004 | Ehrsam et al. | |
| 2001/0052550 | A1 * | 12/2001 | Janssens | 238/382 |

FOREIGN PATENT DOCUMENTS

| | | | |
|---|---|---|---|
| DE | 003834329 A1 | * | 4/1989 |
| DE | 004000992 A1 | * | 7/1991 |
| JP | 52-18613 | * | 8/1975 |
| JP | 404047001 A | * | 2/1992 |

* cited by examiner

*Primary Examiner*—Mark T Le
(74) *Attorney, Agent, or Firm*—The Reilly Intellectual Property Law Firm, P.C.; John E. Reilly

(57) ABSTRACT

A rail cover and support for mounting and insulating the rails of an electric transit system in which the rail cover is vulcanized both to the rail and outer skid support at the manufacturing site prior to delivery to the field and a rail cover completely surrounds both the base flange and web portion of each rail and terminates along the undersides of the top flange. In one form, the upper free ends of the rail cover are increased in thickness to form bumpers along opposite sides of the rail to cushion it against undue shifting or vibration. In fabricating the rail, a sheet dielectric material is vulcanized to the rail with or without a skid plate.

16 Claims, 1 Drawing Sheet

INSULATED RAIL FOR ELECTRIC TRANSIT SYSTEMS AND METHOD OF MAKING SAME

BACKGROUND AND FIELD

This invention relates to railway systems and more particularly relates to a novel and improved rail adaptable for use in electric transit systems of metropolitan areas.

It has been proposed in the past to utilize resilient pads beneath the lower flanges of railroad rails as well as railroad ties for cushioning the rails and insulating them electrically from the ties and from other underlying structures. In many cases, clamps are employed on opposite sides of the lower flange which are in turn anchored into the railroad ties or rail bed. Also, in some cases an adhesive is interposed between the pad and the rail.

Different considerations are involved in the construction and installation of rails for urban transit systems which are typically employed as a part of electrical transit systems and must be mounted in asphalt or concrete roadways. Instead of a gravel or dirt roadbed the rails are embedded in spaced parallel channels formed out of the existing roadway such that the top or head of the rail projects slightly above the upper end of the channel or roadway surface. In the past, rubber boots have been loosely disposed in surrounding relation to the bottom flange of the rail and typically held in place with the use of clamps extending along the entire length of the rail system. This approach has been unsatisfactory particularly from the standpoint of complete vibration and sound-proofing as well as providing the necessary resistance to corrosion resulting from stray electrical current. In stray current corrosion, an electrical current flowing in the environment adjacent to a structure causes one area on the structure to act as an anode and another area to act as a cathode. For example, in an electric railway, a pipeline or other structure may become a low resistance path for the current returning from the train to the power source. Whenever the pipeline is caused to be more positive by the stray current, corrosion occurs at a higher rate but can be avoided by proper insulation of the rail.

Over extended periods of time, rail systems of the type described have been wholly inadequate to achieve the necessary vibration and sound-proofing and to avoid corrosion from stray or leakage current of the types described.

SUMMARY

It is therefore an object to provide for a novel and improved insulated rail system and method of making same.

It is another object to provide for a novel and improved rail system, which is rugged, durable and comprised of a minimum number of parts.

It is a further object to provide for a novel and improved insulated rail system which is vibration and sound-proof as well as capable of substantially eliminating any corrosion resulting from stray or leakage current and which enables greatly simplified installation over extended distances.

It is an additional object to provide for a novel and improved method of manufacturing insulated rail in a minimum number of steps and which results in the formation of a rubber clad rail assembly.

According to one aspect, a transportation rail extends along a rail bed, the rail having a bottom flange, top flange along which a train or other vehicle is advanced, and a vertical web portion interconnecting the bottom and top flanges and wherein the improvement comprises a rail cover composed of a dielectric vulcanizable material including a lower seat portion surrounding and vulcanized to the bottom flange and upper side portions covering and vulcanized to opposite sides of the web portion up to the top flange, and wherein said cover acts as a barrier against chemical attack and electrolytic corrosion of said rail. In another aspect, a rigid skid plate surrounds the sides and underside of the bottom flange prior to placement in the guideway or channel formed in the roadway when used for electric trains, and lateral extensions of the sides of the cover may cushion the rail against lateral thrusting or shifting.

A method of manufacturing a rail section of the type described comprises the steps of positioning a sheet of a flexible dielectric material in surrounding relation to the base flange and opposite sides of the web portion along the substantial length of the rail section, and vulcanizing the sheet under heat and pressure to the rail section. If a skid plate is employed, the method further comprises the additional step of positioning the skid plate in surrounding relation to an underside and opposite sides of the bottom flange and vulcanizing the cover sheet and skid plate together with the rail. The cover sheet may be extruded into the desired configuration prior to vulcanization and given additional thickness along opposite sides of the web portion, or separate strips of a flexible dielectric material may be adhered to the sides of the cover sheet for additional cushioning and sound-proofing.

The above and other objects, advantages and features of the present invention will become more readily appreciated and understood from a consideration of the following detailed description of preferred and modified forms of the present invention when taken together with the accompanying drawings in which:

DETAILED DESCRIPTION OF THE EMBODIMENTS

Figure 1:
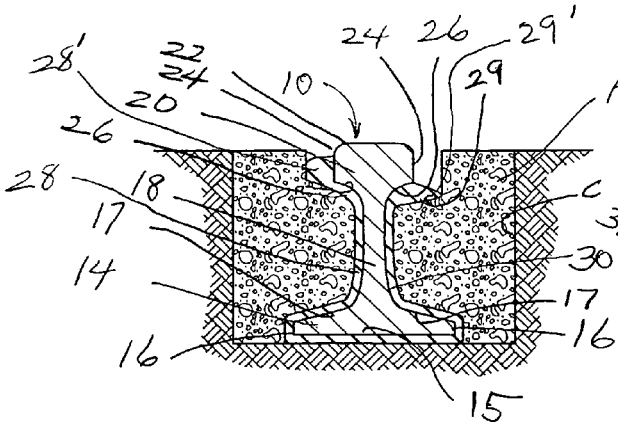
FIG. 1 is a cross-sectional view of one embodiment of rail.

Referring in more detail to the drawings, FIG. 1 illustrates a composite rail, which is made up of a standard rail 10 and a rail cover 12. The rail 10 is of generally I-shaped cross-sectional configuration having a bottom flange 14 provided with a flat undersurface 15 and opposite sides 16 together with sloped upper surfaces 17 which merge into a vertical web portion 18. A top flange 20 has a slightly convex top surface 22 and opposite sides 24 together with sloped undersurfaces 26 which merge into the upper end of the vertical web portion 18. In accordance with conventional practice, the rail may be composed of various grades of steel or aluminum depending upon load requirements. As a setting for the one embodiment, the rail is composed of steel and is designed with a relatively broad base flange 14 in comparison to the width of the top flange 20.

In the one embodiment, the rail is adapted for use as a railroad track for the prevention of corrosion due to stray current leakage in electrified rail transit systems operating in metropolitan areas. To this end, the rail 10 is clad with a tough, durable elastomeric sheet or cover 30 which is vulcanized to the rail and specifically in such a way as to cover the entire base flange 14, opposite sides of the web portion 18 and undersides 26 of the top flange 20. One side 28 of the cover is of progressively increased thickness along the underside of the top flange and terminates in a lobe 28' along one side of the top flange; whereas, the opposite side 29 is of progressively increased thickness along the underside of the top flange and terminates in a tapered end 29' beneath the side of the top flange so as to leave clearance along that side for the wheel flange of each of the train wheels.

Figure 2:
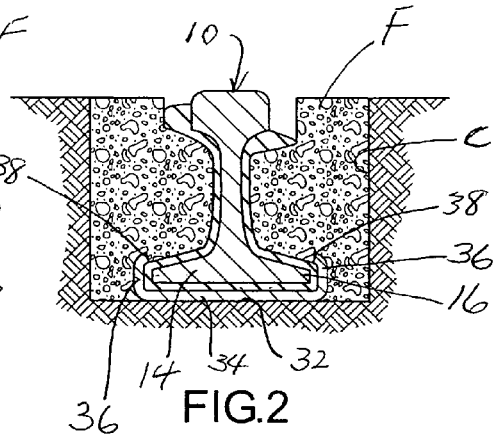
FIG. 2 is a cross-sectional view of another embodiment of rail.

FIG. 2 illustrates another embodiment in which a skid plate 32 of generally channel-shaped cross-sectional configuration is mounted on the rail directly to the rail cover 30 extending along the underside 15 and opposite sides 16 of the base flange 14. Thus, the skid plate 32 includes a substantially flat base 34 and opposite sides 36 which are bent into generally concavo-convex configuration in tightly surrounding relation to the opposite sides 16 and terminate in upper edges 38 which overlie outer ends of the sloped upper surfaces 17.

The rail cover 30 is vulcanized by subjecting to high pressure and super-heated steam so as to bond the cover both to the steel rail 10 and skid plate 32. This procedure creates an impermeable barrier which protects the surrounding environment from the costly and often hazardous ravages of electrolytic corrosion. In the form of FIG. 2, the sides of the rail cover are of uniform thickness and terminate along the undersides of the top flange.

Figure 3:
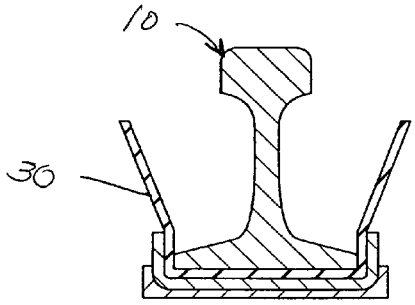
FIG. 3 is a cross-sectional view illustrating one step in the process of manufacturing the embodiment shown in FIG. 2.
Figure 4:
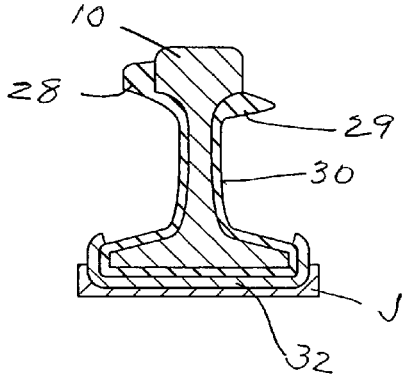
FIG. 4 is a cross-sectional view of another step involved in the process of manufacturing the embodiment shown in FIG. 2.

FIGS. 3 and 4 illustrate the steps followed in the fabrication of one embodiment of rail system as hereinbefore described. The rail 10 is customarily cut into 40' long sections, and a bonding agent is applied to the bottom flange 14 and web portion 18 as well as the undersides of the top flange 20 throughout the entire length of the section. The sheets of rubber making up the rail cover 20 are cut into shorter lengths than the rail section so as to leave several inches at each end of the rail section exposed for welding the section ends as hereinafter described. Similarly, the skid plate 32 is formed into sections slightly shorter in length than the rail sections 10 so as not to interfere with the welding operation. At the manufacturing site, each skid plate section 34 is positioned in a steel channel jig J and, as illustrated in FIG. 3, each length of the rail cover 30 is placed in the skid plate 32 with opposite sides of the cover 30 extending upwardly beyond opposite sides 36 of the skid plate 34. The upper ends 38 of the opposite sides 36 are bent or crimped over the outer ends of the rail. Again, a suitable bonding agent is placed along the inner contacting surfaces of the rail 10 as a preliminary to applying the free sides of the cover 30 into contacting relation to the upper surfaces 17 and opposite sides of the web section 18 into the configuration illustrated in FIG. 3, although it will be appreciated that the bonding agent may be applied to the entire inner surface of the entire cover 30 rather than the rail 10 prior to placement beneath the rail. A suitable crimping tool is then employed to crimp the upper ends 38 of the skid plate 32 over the outer ends of the upper surfaces 17. In another preferred form, the rubber cover 30 may be extruded into the desired rail-shaped configuration as illustrated into FIG. 2 prior to the vulcanization step now to be described.

Each rail section is typically on the order of 40' in length and may be vulcanized in a suitable press to subject it to the desired high pressure and super-heated steam level over a predetermined time interval depending to a great extent on the thickness of the cover 30. For the purpose of illustration but not limitation, the rail cover 30 may be on the order of ¼" thick for a rail which is on the order of 8" high. The composition of the rail cover 30 is totally impervious to moisture penetration and is highly resistant to harsh chemicals, such as, street de-icers, other acids or salts and automotive exhaust gases. It can withstand severe impact and abrasion and easily endures the usual rough handling and hauling from the plant to the rail site.

The skid plate 32 is useful as a means of protecting the rail cover when installed in the rail bed. For example, in an electric transit system, each rail of the railroad track is placed in a separate channel or shallow recess formed in the pavement of the roadway, as illustrated in FIGS. 1 and 2. As best seen from FIG. 5, typically the ends of the rail section are welded together as at 50 and the weld seams are cleaned, covered, sealed and insulated by on-site application of a sealant. If it should be necessary to leave a gap between the end of the cover 30 and the end of rail section 10, a heat-cured patch 52 is applied to the exposed ends of the rail sections 10 between the terminal edges of the rail covers 30 of adjoining rail sections. Preferably, the patch 52 is molded or extruded into the same cross-sectional configuration as the rail cover 30 and cured at the factory site. Upon completion of the welding operation, the patch 52 is slipped over the rail and chemically cured or heated with the opposite edges of the patch butt-welded or cured together with the ends of the rail covers 30 as designated at 54.

Figure 5:
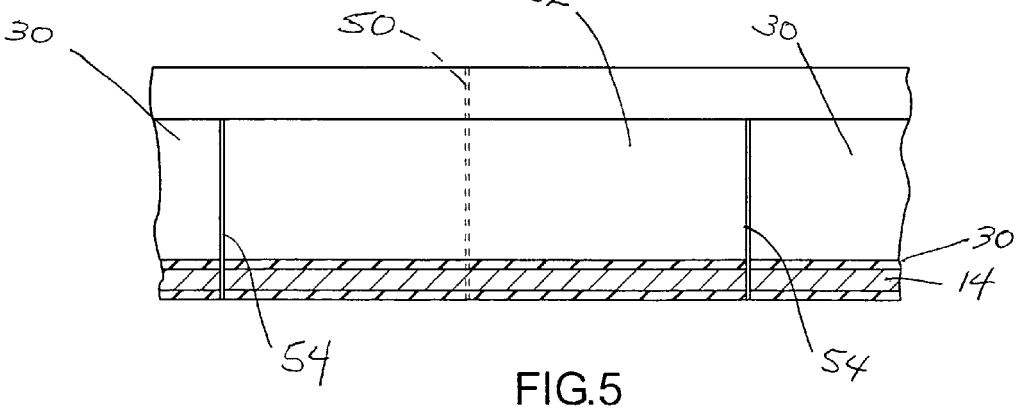
FIG. 5 is a side elevational view illustrating welded rail sections covered by a patch as a part of the insulated rail system.

FIG. 5 illustrates the rail sections welded together and patched as described without the use of skid plates 32. In other words, the rail 10 corresponds to that shown in FIG. 1 and may be installed in the rail channels C without adding the skid plates 32. Whether employed with or without the skid plates 32, a suitable filler as designated at F in FIGS. 1 and 2 is illustrated as being placed around the rails after they have been laid and welded in the channels. In either preferred form as shown in FIG. 1 or 2, the filler may be a concrete filler although it will be apparent that other types of commercial fillers may be employed, taking care to leave a gap G between the filler and one side 24 of the top flange 20 so as not to interfere with the train wheel.

From the foregoing, the rail cover 30 is characterized in particular by acting as an insulator to prevent electrolysis and as a corrosion-proof barrier to prevent electro-chemical attack, such as, oxidation of the steel or by exposure to corrosive chemicals, such as, street de-icers or by automobile exhaust and other acids. Thus, it is highly important to vulcanize the rail cover 30 to the entire rail surfaces other than the wear surfaces so as to act as an effective barrier against chemical attack as well as electrolytic corrosion.

It is therefore to be understood that while plural embodiments are herein set forth and described, the above and other modifications may be made therein without departing from the spirit and scope of the invention as defined by the appended claims and reasonable equivalents thereof.

I claim:

1. In an electrified transportation rail system having a plurality of elongated rail sections assembled in end-to-end relation for extension along a rail bed, each said rail section having a bottom flange, top flange along which a train or other vehicle is advanced, and a vertical web portion interconnecting said bottom and top flanges, the improvement comprising:

a rail cover vulcanized to each of said rail sections, said cover composed of a solid sheet of flexible dielectric vulcanizable material, said rail cover vulcanized and bonded under heat and pressure to each of said rail sections prior to being assembled in said railbed, said cover including a lower portion surrounding and vulcanized to said bottom flange and an upper portion covering and vulcanized to opposite sides of said web portion; and an insulating member overlapping each pair of adjacent ends of said rail sections, said insulating member and said rail cover having similar cross-sections and being joined together to act as a barrier against stray current flow along the length of the rail sections.

2. In a transportation rail system according to claim 1 wherein a bonding agent is interposed between said cover and said lower portion.

3. In a transportation rail system according to claim 2 wherein said bonding agent is interposed between said cover and said web portions.

4. In a transportation rail system according to claim 1 wherein adjacent ends of said rail sections, said insulating member and said covers are joined together.

5. In a transportation rail system according to claim 1 wherein each of said covers is composed of an elastomeric material, and said insulating member joining together adjacent facing ends of said covers.

6. In a transportation rail system according to claim 1 wherein each of said covers extends upwardly along at least a portion of an undersurface of said top flange.

7. In a transportation rail system according to claim 6 wherein each of said covers increase in thickness upwardly along said undersurface of said top flange.

8. In a transportation rail system according to claim 6 wherein each of said covers increases in thickness along one undersurface and outer end of said top flange.

9. In an electrified rail transit system wherein a pair of spaced parallel channels are formed in a roadway and a railroad track is adapted for extension along each of said channels and each said track including a plurality of rail sections, each of said rail sections having a bottom flange, top flange along which the flanged wheel of a train is advanced, and a vertical web portion interconnecting said bottom and said top flanges, the improvement comprising:

a rail cover vulcanized and bonded under heat and pressure to each of said rail sections prior to being assembled in said railbed, said cover composed of a solid sheet of a flexible dielectric vulcanizable material, said sheet including a lower portion covering and vulcanized to said bottom flange and upper side portions covering and vulcanized to opposite sides of said web portion up to said top flange; and an insulating member overlapping each pair of adjacent ends of said rail sections, said insulating member and said rail cover having similar cross-sections and being joined together to act as a barrier against stray current flow along the length of the rail sections.

10. In an electrified rail transit system according to claim 9 wherein said cover extends upwardly along an undersurface of said top flange.

11. In a transportation rail according to claim 10 wherein said cover increases in thickness upwardly along said undersurface of said top flange.

12. In a transportation rail according to claim 9 wherein said cover increases in thickness along one side of an undersurface and an outer end of said top flange.

13. A method of manufacturing an electrified rail transit system, wherein a pair of spaced parallel channels are formed in a roadway and a railroad track is adapted for extension along each of said channels and each said track including a plurality of rail sections assembled together in end-to-end relation, each said rail section being comprised of a base flange, top flange and web portion interconnecting said top and bottom flanges into a generally I-shaped configuration comprising the steps of:

positioning a sheet of a flexible vulcanizable dielectric material to cover said base flange and opposite sides of said web portion along a substantial length of each said rail section prior to being assembled together in said channels;

vulcanizing and bonding said sheet to each of said rail sections under heat and pressure along the substantial length thereof prior to assembly of said rail sections in end-to-end relation along each of said channels; and providing an insulating member overlapping each pair of adjacent ends of said rail sections, said insulating member and said rail cover having similar cross-sections and being joined together to act as a barrier against stray current flow along the length of the rail sections.

14. The method according to claim 13 including the step of placing said sheet in a generally U-shaped rigid support member prior to the vulcanizing step.

15. The method according to claim 13 including the step of assembling a plurality of rail sections together in end-to-end relation along each said rail section, welding abutting ends of said rail sections together, and joining adjacent facing ends of said covers with said insulating members.

16. The method according to claim 13 wherein said sheet is extruded into a generally rail-shaped configuration and placed on each said rail section prior to the vulcanizing step.

* * * * *